US006290119B1

(12) United States Patent
Reese et al.

(10) Patent No.: US 6,290,119 B1
(45) Date of Patent: Sep. 18, 2001

(54) COMPOSITE CONTAINER HAVING FILM LABEL PLY AND METHOD FOR MANUFACTURING SAME

(75) Inventors: Barry R. Reese, Hartsville; Jeffrey M. Schuetz, Florence; Alan D. Williams, Camden, all of SC (US)

(73) Assignee: Sonoco Development Inc., Hartsville, SC (US)

( * ) Notice: Subject to any disclaimer, the term of this patent is extended or adjusted under 35 U.S.C. 154(b) by 0 days.

(21) Appl. No.: 09/435,913

(22) Filed: Nov. 8, 1999

(51) Int. Cl.[7] ..... B65D 3/28

(52) U.S. Cl. ..... 229/4.5; 206/459.5; 229/5.83; 428/34.2

(58) Field of Search ..... 229/4.5, 5.83; 206/459.5; 428/34.2, 35.3

(56) References Cited

U.S. PATENT DOCUMENTS

| | | | | |
|---|---|---|---|---|
| 3,042,285 | | 7/1962 | Smith . | |
| 3,096,014 | | 7/1963 | Swan . | |
| 3,122,305 | | 2/1964 | Young . | |
| 3,202,566 | | 8/1965 | Schur . | |
| 3,371,841 | | 3/1968 | O'Neal, Jr. . | |
| 3,386,645 | | 6/1968 | Powell . | |
| 3,423,231 | | 1/1969 | Lutzmann . | |
| 3,423,341 | | 1/1969 | Klore et al. . | |
| 3,656,513 | | 4/1972 | Evans et al. . | |
| 3,940,496 | * | 2/1976 | Turpin et al. | 229/4.5 |
| 3,981,433 | | 9/1976 | Thornhill et al. . | |
| 4,093,073 | | 6/1978 | Leezer . | |
| 4,235,341 | | 11/1980 | Martin et al. . | |
| 4,257,316 | * | 3/1981 | Roder et al. | 493/68 |
| 4,286,745 | * | 9/1981 | Fukuoka | 229/4.5 |
| 5,076,440 | | 12/1991 | Drummond . | |
| 5,084,284 | | 1/1992 | McDilda et al. . | |
| 5,251,809 | | 10/1993 | Drummond et al. . | |
| 5,326,023 | | 7/1994 | Rice et al. . | |
| 5,888,640 | * | 3/1999 | Marotta et al. | 428/35.3 |
| 6,003,670 | | 12/1999 | Beer . | |
| 6,152,355 | * | 11/2000 | Morrow et al. | 206/459.5 |

FOREIGN PATENT DOCUMENTS

| | | |
|---|---|---|
| 0 509 772 A1 | 10/1992 | (EP) . |
| 0 822 063 A1 | 2/1998 | (EP) . |
| 0 857 567 A2 | 8/1998 | (EP) . |
| 0 949 152 A1 | 10/1999 | (EP) . |
| 0 952 087 A2 | 10/1999 | (EP) . |
| 1.087.723 | 11/1953 | (FR) . |
| 587163 | 5/1944 | (GB) . |
| 957333 | 5/1962 | (GB) . |

* cited by examiner

*Primary Examiner*—Gary E. Elkins
(74) *Attorney, Agent, or Firm*—Alston & Bird LLP

(57) ABSTRACT

A multi-ply composite container for consumer products is provided having a tubular body ply, a liner ply and a film label ply. The tubular body ply is formed of paperboard material, and the liner ply is adhered to the inner surface of the tubular body ply. The film label ply is adhered to the outer surface of the tubular body ply and is comprised of a polymeric film having inner and outer surfaces and an adhesive on at least a portion of the inner surface of the polymeric film. Graphical matter can be included on at least a portion of the inner surface of the polymeric film under the adhesive. The adhesive is for adhering the label ply to the outer surface of the tubular body ply and can be either a heat seal coating or a cold seal coating.

27 Claims, 4 Drawing Sheets

COMPOSITE CONTAINER HAVING FILM LABEL PLY AND METHOD FOR MANUFACTURING SAME

FIELD OF THE INVENTION

The present invention relates to composite containers for food products, and more particularly, to multi-ply tubular containers constructed of a paperboard body ply, an inner liner ply and a decorative label ply.

BACKGROUND OF THE INVENTION

In the packaging of perishable food products, a container is required that is rigid enough to retain its shape when subjected to internal pressure produced in the container while tightly sealing the food product to protect against deterioration, leakage and contamination. Thus, perishable food products are often packaged in composite tubular containers that are sealed at both ends. The tubular body portion of these containers conventionally includes three separate plies or sets of plies.

First, at least one structural body ply made of paperboard material is included, which is formed into a tubular structure by wrapping a continuous strip of body ply paperboard material around a shaping mandrel. The body ply strip may be spirally wound around the mandrel or passed through a series of forming elements so as to be wrapped in a convolute shape around the mandrel. The tube is then cut into predetermined lengths at the downstream end of the mandrel and fitted with end caps to complete the container.

Second, these containers typically include a liquid impermeable liner ply adhered to the inner surface of the paperboard body ply. The liner ply seals the food product, such as potato crisps, chips or juice, within the container, and also prevents liquids, which may possibly contaminate the food product, from entering the container. Some liner plies are also gas impermeable, so as to not only prevent food product odors from escaping the can, but also prevent atmospheric air from entering the container and spoiling the food product. Thus, while the purpose of the body ply is to provide necessary structural properties to the container, the liner ply provides barrier properties necessary to protect and maintain the perishable food product.

Finally, a label ply, which is typically a paper-based ply, is included and adhered to the outer surface of the paperboard body ply. The label ply serves two primary functions. First, a composite can label is a source of information. The label carries the graphical matter that conveys product information, instructions, and regulatory compliance information. The label is also preferably decorative and aesthetically pleasing to the consumer, which enhances shelf appeal and increases consumer interest in the food product. In particular, the gloss of a label is important for consumer appeal, with high and even gloss being preferable.

The graphics included on conventional paper labels are either rotogravure or flexographically printed and, to protect the inks used in the label printing process, may require thermosetting-type overlacquers over the inks. However, the overlacquers may not absorb evenly into the paper and thus create labels that have inconsistent gloss characteristics. In addition, the gloss levels attainable with paper labels are limited because of the surface roughness characteristics of the paper.

The second function of the label ply is to provide some physical characteristics to the composite can. The coefficient of friction of the label ply is important because the lower the coefficient of friction, the easier the composite container is handled. The container is often routed along conveyor lines and chutes as it manufactured, filled and then shipped. Thus, a composite container with a high coefficient of friction can create inefficiencies in product packaging and increase the cost of packaging the food product, while a container with a low coefficient of friction can minimize such inefficiencies and costs.

Also, the wet strength of the label ply can be an important factor in composite container design. If the container is exposed to moisture and the paperboard body ply gets wet, the strength of the can is compromised. Such moisture is sometimes encountered during shipping. At other times, condensation may form on the surface of the can if the can is refrigerated or otherwise exposed to cold temperatures and then moved to a warmer, humid environment. If the wet strength of the label ply is low, then the label will provide little additional relief to the body ply from premature rupturing of the container.

The wet strength of conventional paper label plies is especially important when the plies are used in conjunction with composite cans for dough. Composite dough cans are designed differently from other composite containers such that they can be opened by forcefully striking the container against a sharp surface, such as the edge of a kitchen counter. The edges of the body ply strip are typically abutted and held together with an unadhered or lightly adhered joint or seam. The label ply is thus designed to provide a substantial component of the total strength of the can necessary to prevent the can from prematurely opening. Accordingly, when the label ply or other outer wrapper is completely removed, the internal pressure of the dough and the force of impact against a sharp edge causes the body ply seam to separate, thus allowing the dough product to be removed from the can. As noted above, the container may be exposed to moisture which can weaken the paperboard ply. This makes the strength of the label ply even more critical and, if it is also exposed to moisture and has a low wet strength, as is the case with most paper labels, the container may prematurely rupture.

Several prior patents have mentioned the possible use of labels for dough cans or easy-open containers which are made of polymeric film. For example, U.S. Pat. No. 3,981,433 to Thornhill et al. discloses a composite container for dough with a peelable outer reinforcing or wrapper layer. According to the '433 patent, the peelable outer wrapper layer can be formed of paper, metal foil, or a suitable synthetic plastic material, such as polyethylene adhesively bonded to the outer surface of a fibrous body wall layer by way of a separately applied polyvinyl alcohol adhesive. U.S. Pat. No. 4,235,341 to Martin et al. discloses a dough container having inner and outer plies over a fiber board body ply. According to one embodiment the inner ply is a coextruded polyethylene/polystyrene film. The outer ply is described as a thermoplastic paper film. U.S. Pat. No. 5,076,440 to Drummond discloses a dough container having a label which can be of plastic film. U.S. Pat. No. 5,084,284 to McDilda et al. discloses a dough container with a label that can be made of a plastic film. U.S. Pat. No. 5,326,023 to Rice et al. discusses a dough container wherein the label layer is formed of a "suitable biaxially oriented polymer film." The film discussed therein comprises a polypropylene film.

These films could theoretically provide improved wet strength for dough can labels. However, the types of films potentially usable for dough can labels are limited. The label must be fairly easily removable so that the consumer can open the container to obtain the dough product inside. Accordingly, the type of film used must be easily separable from the body ply and easily graspable by the consumer to allow removal. Also, to properly open dough cans, the label is preferably completely removed or at least completely torn along a predetermined line so that the spiral seam of the body ply can be completely separated. Accordingly, the film label must be of such a type that it can be easily and completely removed from the container. Only films which have predictable tear characteristics; i.e, those which tear in a predictable direction when pulled by a consumer, could be used for dough cans because of the difficulty in completely removing the label or exposing the body ply seam. However, films having predictable tear characteristics may not provide desired levels of gloss or be of sufficiently low cost to be produced commercially. In addition, any graphics or other information printed on the film labels as proposed by the prior dough container patents would be exposed to scratching during handling of the containers, thus making a less attractive appearance.

Accordingly, it would be desirable to provide a decorative composite container and a method for manufacturing such a container that increases the gloss and decorative aspects of the container to enhance consumer appeal. Such a container would have improved label ply wet strength compared to paper labels and a decreased coefficient of friction. The container would have graphics which are protected from scratching but which are also sufficiently decorative to attract the consumer's attention and make it more likely that the consumer will purchase the product.

SUMMARY OF THE INVENTION

These and other needs are provided, according to the invention, by a decorative composite container for consumer products other than dough having a tubular body ply, a liner ply and a film label ply which is permanently adhered to the body ply. The film label ply can be formed of any decorative polymeric film, including those having unpredictable tear characteristics. One example is polyethylene terephthalate, which is very glossy and decorative. Polyethylene terephthalate films would not be used with dough containers because they can be thin and difficult to grasp for the consumer. More particularly, however, polyethylene terephthalate films have unpredictable tear directions which would make it difficult for consumers to remove the label. In the case of nondough containers in accordance with the present invention, the film label is permanently adhered to the body ply and thus its tear characteristics do not need to be considered in the choice of film types. The film label ply is also preferably transparent and various graphical indicia are printed on the side of the film against the surface of the body ply. In this manner, the graphics are protected from scratching, etc., a problem which affects conventional labels.

More particularly, a tubular composite container for advertising products contained therein to consumers is provided wherein the tubular body ply is formed of paperboard material having inner and outer surfaces and opposed ends. The liner ply is adhered to the inner surface of the tubular body ply and the film label ply is adhered to the outer surface of the tubular body ply.

The film label ply comprises a polymeric film having inner and outer surfaces and, as noted above, is formed of a polymeric material which is substantially transparent. The polymeric film preferably comprises the polyethylene terephthalate film mentioned above. The polymeric film label ply preferably has a kinetic coefficient of friction at least as low as about 0.3. A nitrocellulose overlacquer may be applied on the outer surface of the polymeric film to obtain a coefficient of friction preferably as low as 0.2 to improve handling of the composite container.

The graphical indicia are applied on at least a portion of the inner surface of the film so as to be visible through the film to the consumer. An adhesive is in contact with at least a portion of the inner surface of the polymeric film for adhering the label ply to the outer surface of the tubular body ply. The adhesive can be applied over the graphical indicia so as to cover substantially the entire inner surface of the polymeric film over the graphical indicia and, in particular, the adhesive can be printed on the film. The adhesive can also be applied to the inner surface of the polymeric film in a pattern of strips or in a pattern of dots. The adhesive can be a heat seal coating, a cold seal coating or even a pressure sensitive adhesive.

The film label ply is wrapped around the body ply so as to create overlapped edges defining a seam extending between the opposed ends of the tubular body ply. A hot melt adhesive can be applied between the overlapped edges for bonding the overlapped edges, or the adhesive used to adhere the film label ply to the body ply can be used to also adhere the overlapped edges together.

The decorative tubular composite container according to the invention is for use with consumer products other than dough and thus is designed to be opened only through one or both ends thereof. The tubular body ply has a seam at which opposite edges of the paperboard material are permanently adhered together. In addition, the adhesive on the polymeric film is used for permanently adhering the label ply to the outer surface of the tubular body ply. Associated methods also form a part of the invention.

Therefore, the invention provides a decorative multi-ply composite container having graphical indicia applied to the inner surface of the label. The graphical indicia are thus protected from external forces. The polymeric film label ply also increases the gloss of the label ply while decreasing the coefficient of friction of the outer surface of the composite container. In addition, the wet strength of the film label ply is no less than the strength of the film when not wet. Thus, the multi-ply composite container and method for manufacturing same of the present invention increase the shelf appeal of the composite container and decrease production costs and inefficiencies in the manufacture of composite containers.

BRIEF DESCRIPTION OF THE DRAWINGS

Some of the objects and advantages of the present invention have been set forth and other objects and advantages of the invention will become apparent in the detailed description of the preferred embodiments of the invention to follow, especially when taken in conjunction with the accompanying drawings, which are not necessarily drawn to scale.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
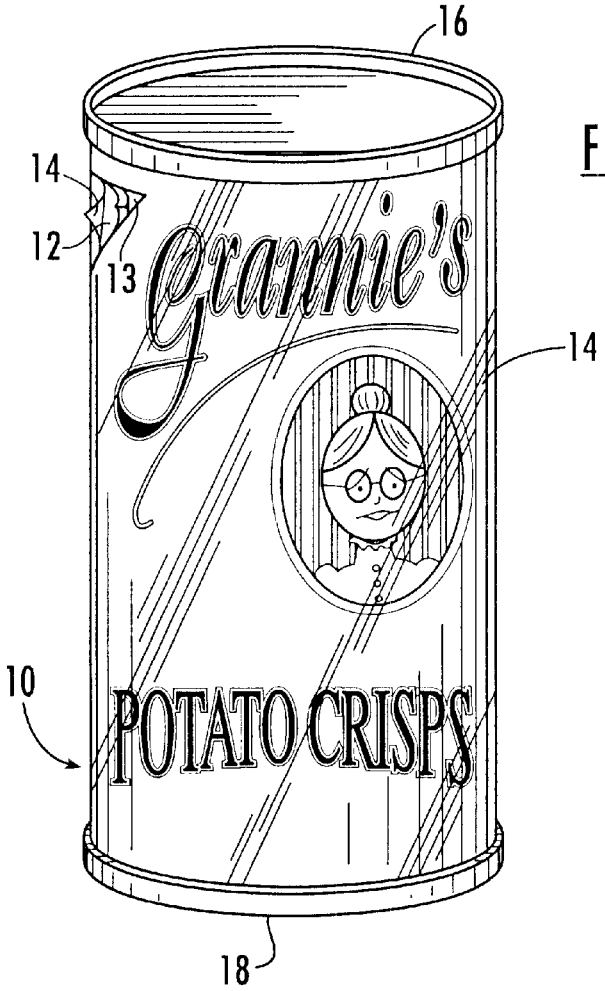
FIG. 1 is a perspective view of a multi-ply composite container according to the present invention.

FIG. 1 illustrates a tubular multi-ply composite container 10 for consumer products according to the present invention. Although illustrated as having a circular cross section, the tube may have any cross sectional shape which can be formed by wrapping the tube around an appropriately shaped mandrel. One example is a generally rectangular shaped tube having rounded corners.

The embodiment illustrated in FIG. 1 is particularly advantageous for packaging snacks such as potato crisps and includes a tubular body ply 12, a liner ply 13 adhered to the inner surface of the tubular body ply 12, and a film label ply 14 adhered to the outer surface of the tubular body ply 12. The liner ply 14 may be omitted in certain applications such as packages for dry materials like salt. The composite container 10 also includes a plastic or metal end cap 16. Various other end closures may be used, such as flexible lidding, depending upon the type of food product which is to be packaged. A plastic or metal closure 18 can be secured to the opposite end of the composite container 10.

Figure 3:
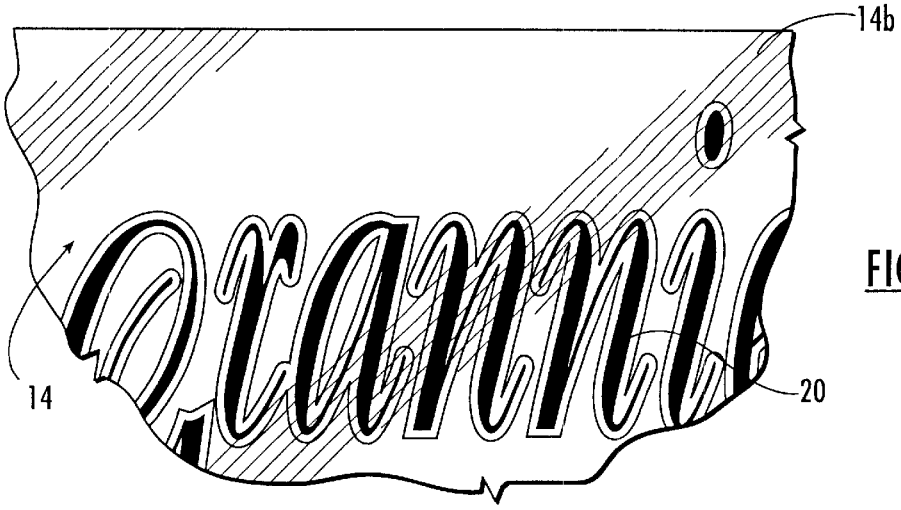
FIG. 3 is a fragmentary and enlarged view of the film label ply demonstrating graphical matter on at least a portion of its inner surface.

The tubular body ply 12 of the composite container 10 is preferably formed of paperboard material, and the film label ply 14, which is adhered to the outer surface of the tubular body ply 12, is preferably formed of a polymeric material. The film label ply 14 can either be transparent or opaque. Referring to FIG. 3, the film label ply 14 has an inner surface 14*a* and an outer surface 14*b*. One type of film label ply 14 that can be used is 48 gauge polyethylene terephthalate, which has high gloss properties and a low coefficient of friction, but which would not be used for dough containers because of its low graspability and unpredictable tear characteristics. Other possible films include 92 gauge polyethylene terephthalate, oriented polypropylene, oriented high density polyethylene, oriented polyamide and laminations thereof.

In one embodiment, the inner surface 14*a* of the film label ply 14 is printed with graphical matter 20, such as product information, package opening instructions, and regulatory compliance information. The graphical matter 20 is preferably printed on the inner surface 14*a* of the film label ply 14 instead of on the outer surface 14*b* of the film label ply 14 by a process known as "reverse printing." Reverse printing the graphical matter 20 on the inner surface 14*a* of the film label ply 14, which is adhered to the outer surface of the tubular body ply 12, advantageously protects the graphical matter 20 from exposure to outside elements, and therefore protects the graphical matter 20 from blurring, staining or scratching. The graphical matter 20 can be rotogravure or flexographically printed, with an overlacquer (not shown) included over the graphical matter 20 to further protect the ink.

Figure 2:
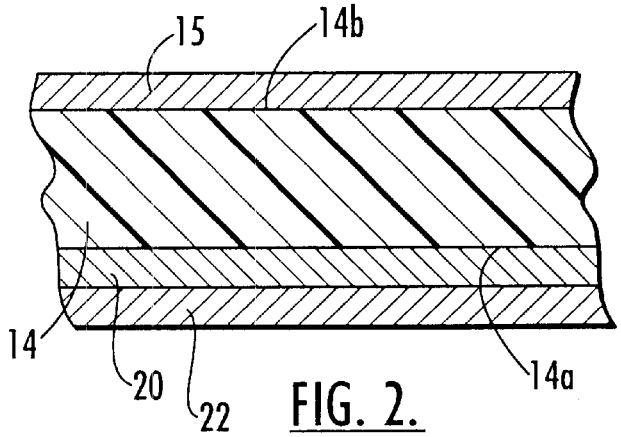
FIG. 2 is a greatly enlarged sectional view of an embodiment of the film label ply according to the present invention.
Figure 4:
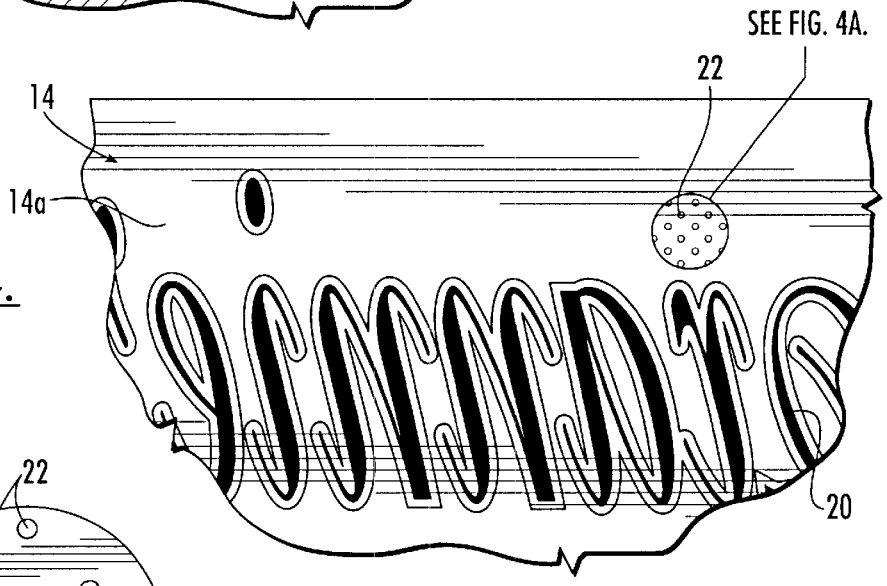
FIG. 4 is a reverse fragmentary and enlarged view of the film label ply of FIG. 3 demonstrating graphical matter and an adhesive in a dot pattern on the inner surface of the film label ply.
Figure 4A:
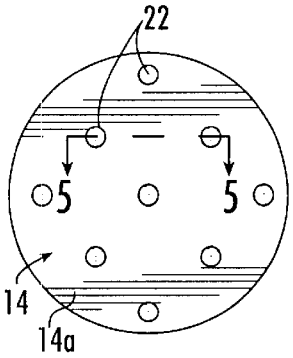
FIG. 4A is an enlarged view of the adhesive in a dot pattern on the inner surface of the film label ply from FIG. 4.
Figure 4B:
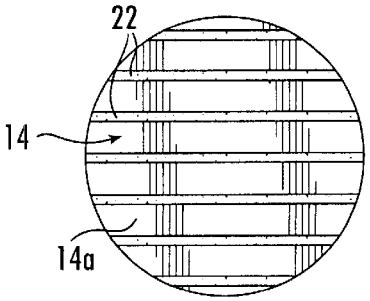
FIG. 4B is an enlarged view of an adhesive on the inner surface of the film label ply in a strip pattern.
Figure 5:
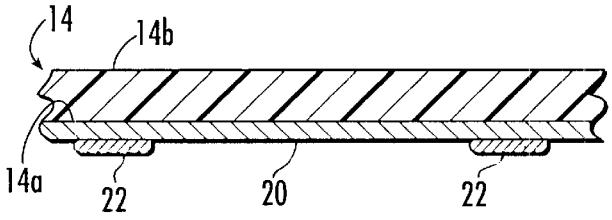
FIG. 5 is a greatly enlarged sectional view of the adhesive in a dot pattern taken along line 5—5 of FIG. 4A.

As shown in FIG. 4, the inner surface 14*a* of the film label ply 14 also preferably includes an adhesive 22 for adhering the film label ply 14 to the outer surface of the tubular body ply 12. The adhesive 22 can either be a heat seal coating that is temperature activated or a cold seal coating that is activated upon the application of pressure. The adhesive 22 could also comprise other adhesives such as pressure-sensitive adhesives and/or water-based EVA adhesives. The adhesive 22 can be applied to the entire inner surface 14*a* of the film label ply 14 and over the printed graphical matter 20 as shown in FIG. 2, or can be disposed only on a portion of the inner surface 14*a* of the film label ply 14 in a pattern of dots, as shown in FIG. 4A, or in a pattern of strips, as shown in FIG. 4B. Although the pattern of strips is shown in a horizontal pattern in FIG. 4B, the adhesive strips can also be printed in an angular pattern, which may be prompted by the process of constructing the container. For example, those skilled in the art will understand that machine direction strips are not preferable because of label ply rewind problems. As shown in FIGS. 2 and 5, the adhesive 22 is disposed on the inner surface 14*a* of the film label ply 14 over the reverse printed graphical matter 20.

An adhesive (such as a water-based adhesive) could also be separately applied to the body ply 12 and/or film label ply 14 during the manufacture of the container such as with rollers and the like. For example, the cold seal coating would preferably be applied to both the tubular body ply 12 and the film label ply 14 to promote better adhesion.

The outer surface 14*a* of the film label ply preferably has a kinetic coefficient of friction at least as low as about 0.3. As shown in FIG. 2, however, the outer surface 14*b* of the film label ply can also be coated with an overlacquer 15 which can reduce the coefficient of friction even lower to at least about 0.2. The overlacquer 15 is advantageously a nitrocellulose overlacquer.

The film label ply 14 is designed such that when the film label ply 14 is adhered to the outer surface of the tubular body ply 12, the film label ply 14 includes overlapped edges defining a seam extending between the opposed ends of the tubular body ply 12. An adhesive is included between the overlapped edges for bonding. The adhesive may be the adhesive 22 mentioned above and/or a separate hot melt adhesive application. The seam facilitates removal of the film label ply 14 from the tubular body ply 12 so that the composite container 10 can be easily opened.

Figure 6:
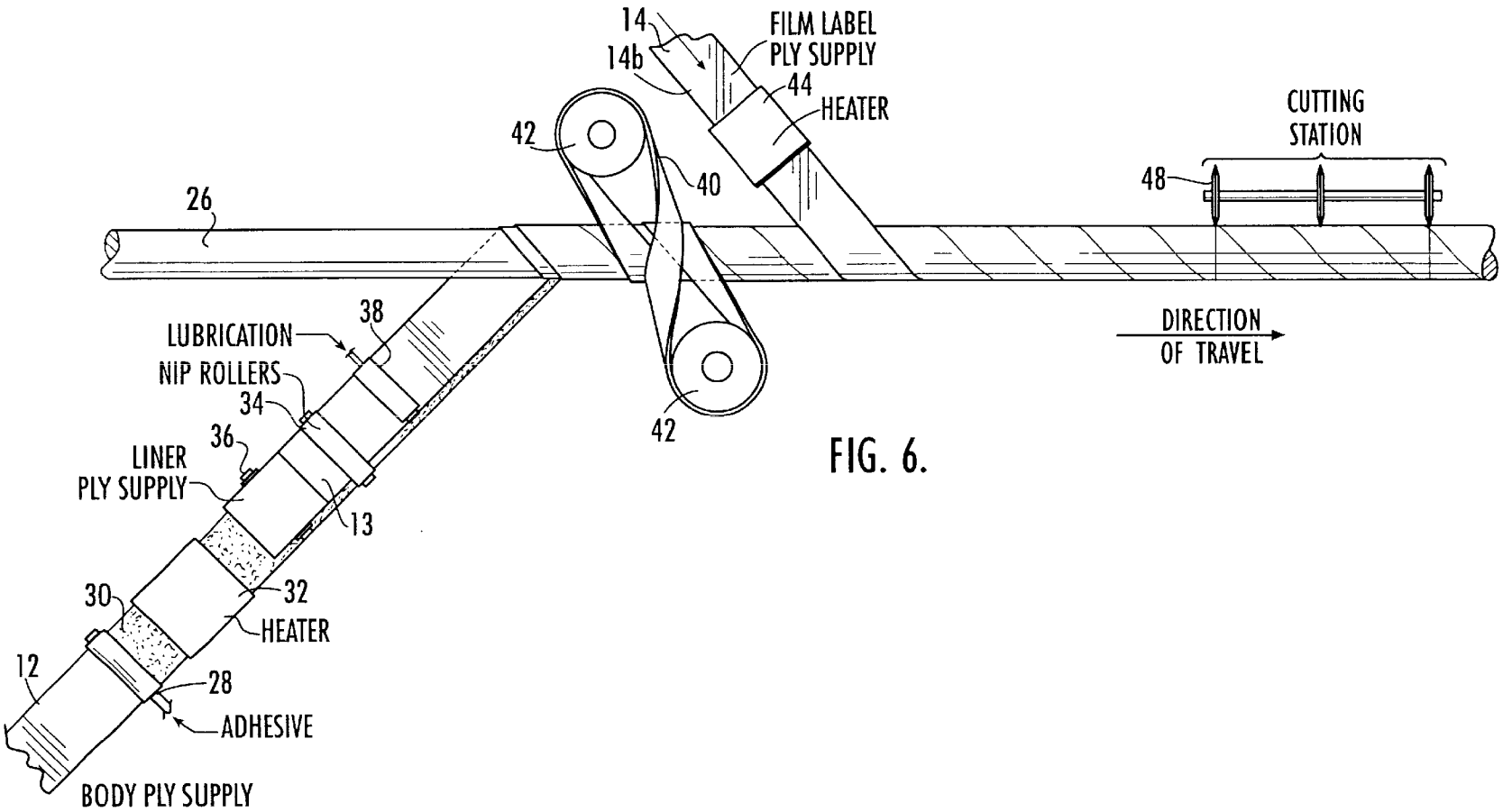
FIG. 6 is a plan view illustrating a method for making multi-ply composite containers according to the present invention using a heat seal coating.

FIG. 6 illustrates a method for making a multi-ply composite container according to the present invention. A continuous strip of paperboard body ply material 12 is first advanced toward a shaping mandrel 26. As the paperboard body ply material 12 is advanced toward the shaping mandrel 26, the body ply 12 is advanced through an adhesive applicator 28 which applies an adhesive 30 to the inner surface of the body ply 12.

The body ply 12 and the adhesive 30 applied thereto are then passed underneath a heater 32 to render the adhesive substantially tacky. A preferred type of heat source is an infrared heater although various other heat sources, e.g., forced air heating or the like can also be used.

After passing underneath the heater 32, the body ply 12 is then advanced into a pair of opposed nip rollers 34. A continuous strip of liner ply material 13 is fed from a reel 36 and is also advanced into the nip 34 adjacent to the adhesived inner surface of the body ply 12. The adhesive 30 is substantially tacky and thus instantaneously bonds to the liner ply 13 without slippage as they are nipped together. It will be understood to those skilled in the art that various liner constructions with various barrier materials or properties could be employed depending upon the item being packing in the composite container 10. The liner ply 13 may be wider or narrower than the body ply 12 depending on the amount of liner overlap that is desired. After advancing the body ply 12 and the liner ply 13 through the pair of nip rollers 34, the liner ply 13 may then be coated with lubricant from a roller 38, which allows the liner ply 13 to slide smoothly during the winding operation.

The body ply 12/liner ply 13 laminate is then wrapped around the shaping mandrel 26. The laminate is first wrapped under the mandrel 26 and then back over the top in a helical fashion with the liner ply 13 wound against the surface of the mandrel 26. As the body ply 12/liner ply 13 laminate advances back under the mandrel 26 after one complete revolution, its trailing edge is brought into contact with the leading edge of the ensuing portion of the body ply 12/liner ply 13 laminate, which is first coming into contact with the mandrel 26. The edges become abutted together to form a spirally wound tube that advances along the mandrel 26.

The tube is then advanced down the mandrel 26 by a conventional winding belt 40 that extends around a pair of opposed pulleys 42. The winding belt 40 not only rotates and advances the tube, but applies pressure to the overlapping edges of the body ply 12 and liner ply 13 to ensure a secure bond between the respective ply edges. Instead of the "same side winding" process discussed above, however, the body ply 12 and liner ply 13 could be brought together at the mandrel 26 from opposite sides of the mandrel in a process known as "opposite side winding." The pressure of the winding belt 40 causes the body ply 12 and liner ply 13 to be adhered together.

Downstream of the winding belt 40, a continuous film label ply 14 having an inner surface 14*a* and an outer surface 14*b* is advanced toward the shaping mandrel 26. At least a portion of the inner surface 14*a* of the film label ply 14 is coated with an adhesive 22 (shown in FIGS. 2 and 4).

FIG. 6 illustrates an embodiment of the method for making a multi-ply composite container wherein the adhesive 22 is a heat seal coating. Thus, prior to reaching the shaping mandrel 26, the film label ply 14 and the heat seal coating 22 included thereon are passed through a heater 44 to activate the seal coating 22. The film label ply 14 is then wrapped around the mandrel 26 onto the advancing body ply 12/liner ply 13 laminate. It should be noted that the label ply 14 could be applied to the advancing body ply 12/liner ply 13 laminate before the winding belt 40.

Figure 7:
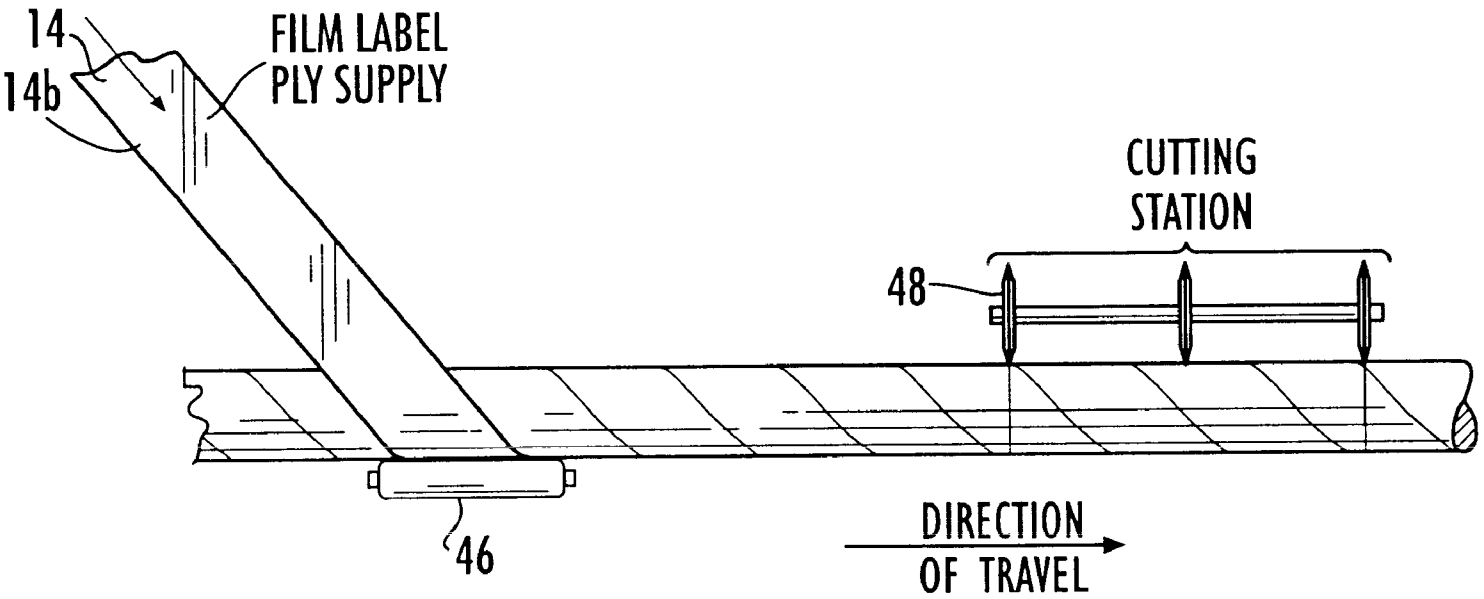
FIG. 7 is a plan view illustrating another embodiment of a method for making multi-ply composite containers according to the present invention.

FIG. 7 illustrates another embodiment of a method for making a multi-ply composite container wherein the adhesive 22 is either a heat seal coating, a cold seal coating or a pressure sensitive adhesive. In this embodiment, the film label ply 14 and the adhesive 22 included thereon are wrapped around the mandrel 26 onto the advancing body ply 12/liner ply 13 laminate and passed under a pressure roller 46 that adheres a label ply 14 to the outer surface of the body ply 12. If a heat seal coating is used, the pressure roller 46 is advantageously heated to activate the coating. The pressure provided by the roller 46 can preferably be adjusted. After the film label ply 14 is adhered to the advancing body ply 12/liner ply 13 laminate on the mandrel 26, the continuous tube is cut into discrete lengths at a cutting station 48, and then removed from the mandrel 26.

Accordingly, the method according to the invention provides a decorative multiply composite container having graphical indicia applied to the inner surface of the label. Accordingly, the graphical indicia are protected from external forces. The polymeric film label ply also increases the gloss of the label ply while decreasing the coefficient of friction of the outer surface of the composite container. Thus, the multi-ply composite container and method for manufacturing same of the present invention increase the shelf appeal of the composite container, and decrease production costs and inefficiencies in the manufacture of composite containers.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed herein and that modifications and other embodiments are intended to be included within the scope of the appended claims. For example, the tubular containers according to the present invention are not necessarily helically wound but may instead be longitudinally wrapped to create a "convolute" tube having an axially extending seam. In addition, although the tubular containers according to the present invention have been described primarily in connection with food products, it is to be understood that the containers could be used in connection with other products. Although specific terms are employed herein, they are used in a generic and descriptive sense only and not for purposes of limitation.

That which is claimed is:

1. A decorative tubular composite container for displaying products contained therein to consumers, said container comprising:

a tubular body ply formed of paperboard material having inner and outer surfaces and opposed ends;

a film label ply adhered to said outer surface of said tubular body ply, said film label ply comprising, a polymeric film having inner and outer surfaces, said film being formed of a polymeric material which is substantially transparent, graphical indicia applied on at least a portion of said inner surface of said film so as to be visible through the film to the consumer, and an adhesive in contact with at least a portion of said inner surface of said polymeric film for adhering said label ply to said outer surface of said tubular body ply.

2. A decorative composite container as defined in claim 1 wherein said adhesive is applied over said graphical indicia.

3. A decorative composite container as defined in claim 2 wherein said adhesive is on substantially the entire inner surface of said polymeric film over said graphical indicia.

4. A decorative composite container as defined in claim 1 wherein said adhesive is printed on said inner surface of said polymeric film.

5. A decorative composite container as defined in claim 1 wherein said adhesive is applied to at least one of the body ply and the liner ply during the manufacture of the container.

6. A decorative composite container as defined in claim 1 wherein said polymeric film comprises polyethylene terephthalate.

7. A decorative composite container as defined in claim 1 further comprising an overlacquer on the outer surface of the polymeric film.

8. A decorative composite container as defined in claim 7 wherein the overlacquer comprises a nitrocellulose overlacquer.

9. A decorative composite container as defined in claim 1 wherein said adhesive is on at least a portion of said inner surface of said polymeric film in a pattern of strips.

10. A decorative composite container as defined in claim 1 wherein said adhesive is on at least a portion of said inner surface of said polymeric film in a pattern of dots.

11. A decorative composite container as defined in claim 1 wherein said adhesive is on substantially the entire inner surface of said polymeric film.

12. A decorative composite container as defined in claim 1 wherein said adhesive is a heat seal coating.

13. A decorative composite container as defined in claim 1 wherein said adhesive is a cold seal coating.

14. A decorative composite container as defined in claim 1, said film label ply further comprising overlapped edges defining a seam extending between said opposed ends of said tubular body ply.

15. A decorative composite container as defined in claim 14, further comprising a hot melt adhesive between said overlapped edges for bonding said overlapped edges.

16. A decorative composite container as defined in claim 14, wherein said adhesive on said film label ply adheres said overlapped edges together.

17. A decorative tubular composite container for consumer products which is designed to be opened only through an end thereof, said container comprising:

a tubular body ply formed of paperboard material having inner and outer surfaces and opposed ends, said tubular body ply having a seam at which opposite edges of the paperboard material are permanently adhered together;

a film label ply adhered to said outer surface of said tubular body ply, said film label ply comprising, a polymeric film having inner and outer surfaces; and an adhesive in contact with at least a portion of said inner surface of said polymeric film for permanently adhering said label ply to said outer surface of said tubular body ply, wherein said polymeric film is substantially transparent and graphical matter is applied on at least a portion of said inner surface of said film so as to be visible through the film to the consumer.

18. A decorative composite container as defined in claim 17 wherein said adhesive is applied to at least one of the body ply and the liner ply during the manufacture of the container.

19. A decorative composite container as defined in claim 17 wherein said polymeric film comprises polyethylene terephthalate.

20. A decorative composite container as defined in claim 17 further comprising an overlacquer on the outer surface of the polymeric film.

21. A decorative composite container as defined in claim 20 wherein the overlacquer comprises a nitrocellulose overlacquer.

22. A multi-ply composite container for consumer products, comprising:

a tubular body ply formed of paperboard material and having inner and outer surfaces; and a polymeric film label ply having inner and outer surfaces wherein said inner surface thereof is adhered to said outer surface of said tubular body ply, wherein the outer surface of the polymeric film label ply has a kinetic coefficient of friction at least as low as about 0.3 to improve handling of the composite container.

23. A decorative composite container as defined in claim 22 wherein said polymeric film label ply is adhered to the outer surface of the tubular body ply by a pressure-sensitive adhesive.

24. A decorative composite container as defined in claim 22 wherein said polymeric film comprises polyethylene terephthalate.

25. A decorative composite container as defined in claim 22 further comprising an overlacquer on the outer surface of the polymeric film.

26. A decorative composite container as defined in claim 25 wherein the kinetic coefficient of friction of the outer surface of the polymeric film label ply is at least as low as about 0.2.

27. A decorative composite container as defined in claim 25 wherein the overlacquer comprises a nitrocellulose overlacquer.

* * * * *